US006758377B2

(12) United States Patent
Uchikoshi

(10) Patent No.: US 6,758,377 B2
(45) Date of Patent: Jul. 6, 2004

(54) SHIRT FINISHING MACHINE AND COVER PUT ON TORSO

(75) Inventor: Mitsuyuki Uchikoshi, Tokyo (JP)

(73) Assignee: Sankousha Co., Ltd., Tokyo (JP)

( * ) Notice: Subject to any disclaimer, the term of this patent is extended or adjusted under 35 U.S.C. 154(b) by 0 days.

(21) Appl. No.: 10/217,712

(22) Filed: Aug. 13, 2002

(65) Prior Publication Data

US 2004/0031824 A1 Feb. 19, 2004

(51) Int. Cl.[7] ..... D06C 15/00
(52) U.S. Cl. ..... 223/73
(58) Field of Search ..... 223/73, 72, 53; 2/123; 38/1 B

(56) References Cited

U.S. PATENT DOCUMENTS 3,568,900 A * 3/1971 Paris ..... 223/70
3,613,969 A * 10/1971 Forse ..... 223/37
4,634,030 A * 1/1987 Uchikoshi ..... 223/57
5,692,326 A * 12/1997 Mohan et al. ..... 38/7
5,758,437 A * 6/1998 Tamamoto ..... 38/12
6,186,377 B1 * 2/2001 McCormick et al. ..... 223/68
6,401,992 B1 * 6/2002 Harrod et al. ..... 223/73

* cited by examiner

*Primary Examiner*—John J. Calvert
*Assistant Examiner*—James G Smith
(74) *Attorney, Agent, or Firm*—Andrus, Sceales, Starke & Sawall, LLP

(57) ABSTRACT

There are provided a torso 2 on which a shirt 1 is put; a pair of front and rear press irons 6 for pressing against a front side and a rear side of the torso 2 to press finish the shirt 1; and a pair of right and left supporting arms 7 arranged at both sides of the torso 2. The upper segments of the supporting arms 7 are provided with an iron table 10 around which the sleeve of the shirt 1 is positioned and set, and with a heating iron 11 for use in press finishing the tuck and the cuff of the shirt sleeve. The upper segments of the supporting arms 7 are provided with clamp devices 12 for use in holding the sleeve end of a short-sleeve shirt 1 and fixing it. The supporting arm 7 is provided with a turning device 13 for turning the upper segments of the supporting arms 7 having the clamp devices 12 and oppositely arranging the clamp devices 12 at the side segment of the torso 2. Thus, the present invention provides a shirt finishing machine in which its sleeves are finished in tension enables not only a long-sleeve shirt but also a short-sleeve shirt to be finished in tension.

5 Claims, 15 Drawing Sheets

SHIRT FINISHING MACHINE AND COVER PUT ON TORSO

BACKGROUND OF THE INVENTION

1. Field of the Invention

This invention relates to a shirt finishing machine, and, more particularly, a shirt finishing machine having a covered torso formed such that wrinkles can be removed by applying irons to a shirt disposed on the torso.

2. Description of the Related Art

As this type of prior art finishing machine, there is U.S. Pat. No. 4,634,030, in which the finishing machine is comprised of a torso to put on a shirt, a pair of front and rear press irons for pressing against a front side and a rear side of the torso for press finishing the shirt, and a pair of right and left supporting arms arranged at both sides of the torso. This type of prior art machine is made such that the upper segments of the supporting arms are normally provided with iron tables around which the sleeve end of the shirt is positioned and set, and the heating irons for press finishing the tuck and the cuff of the shirt.

However, it is desirable that this type of finishing machine enables not only a long-sleeve shirt but also a short-sleeve shirt to be finished.

Because, if the finishing machine is separately applied for each of the long-sleeve shirt and the short-sleeve shirt, its installing space is required to be wide, resulting in that its facility expenditure or some other expenditures for a user is required twice of a single machine and it may produce an inconvenience in operation.

Thus, in the event that this type of prior art finishing machine is formed as a finishing machine for a long-sleeve shirt and a short-sleeve shirt to be finished, it is a usual operation that an expansion bag is installed in the torso, the bag is expanded with hot air to cause the sleeve to be finished in tension.

However, in this type of prior art finishing machine, it was necessary to adjust a fastener at the extremity end of the expansion bag in response to either the long-sleeve shirt or the short-sleeve shirt. That is, in the case of the short-sleeve shirt, it was necessary to close the fastener to cause hot air to be enclosed in the expansion bag. In the case of the long-sleeve shirt, it was necessary to open the fastener in such a way that the hot air reaches up to the extremity end of the sleeve. Accordingly, utilization of this type of prior art finishing machine produced the problem that its operation was troublesome and its convenience in use was inappropriate.

In view of the aforesaid circumstances in the prior art, the present invention has been proposed.

Accordingly, a technical object of the present invention is to provide a shirt finishing machine of a type in which the sleeve is finished in tension not with the expansion bag but with hot air, wherein not only a long-sleeve shirt but also a short-sleeve shirt can be finished in tension easily by the shirt finishing machine.

Thus, it is desirable that the operating mechanism of the press irons in this type of finishing machine can be simplified in its structure, can be reduced in its size and saved in its spacing. If the operating mechanism is intricate and its size is big, the whole finishing machine of this type should be increased in it size and its cost.

Thus, this type of prior art operating mechanism was usually constructed such that the cylinder device was placed in a lateral direction, a rod extending or retracting direction was coincided with an advancing or retracting direction of the press irons, i.e. this prior art type finishing machine caused an occupied area for the operating mechanism to be increased, resulting in that a size of the device was easily increased.

The present invention has been provided a shirt finishing machine which can solve the aforesaid problems of the prior art.

Accordingly, it is another technical issue of the present invention to provide a shirt finishing machine of a type in which the operating mechanism for the press irons can be simplified, its size can be reduced, its space can be saved and the entire device can be decreased in its size, reduced in its space or its price can be reduced.

In addition, in the case of a cover put on the torso of this type of finishing machine and used there, glue used for finishing a shirt enters into a seam in a cloth and easily stains it with steam or hot air blown outwardly through the torso.

Accordingly, if a certain troublesome work is required for replacing this type of cover, it may produce a problem that the number of processing items to be washed is decreased because this type of finishing machine stops in its operation during this replacing work.

In view of the aforesaid point of view, the cover of the present invention has been provided.

Accordingly, it is a technical issue the present invention to provide a cover formed such that installation upon or removal from the torso can be performed easily and rapidly.

SUMMARY OF THE INVENTION

In a shirt finishing machine in which hot air is supplied into the sleeve of the shirt to finish it in tension, the upper segments of the supporting arms provided with the clamp devices for a short-sleeve shirt is formed to enable to turn for having the clamp devices arranged oppositely at side segments of the torso.

Thus, application of the present invention enables not only a long-sleeve shirt but also a short-sleeve shirt to be finished and further enables either an installing space or a cost to be reduced and decreased.

In this case, as shown in FIGS. 2–4, it is preferable in the present invention that the turning device is formed by an air cylinder arranged at the upper segment of the supporting arm, and the upper segment of the supporting arm is formed in such a way that it can be turned around its vertical axis provided along the supporting arm.

Because, with such an arrangement as above, since the turning device is of an air cylinder, an efficient control can be carried out under utilization of a pneumatic circuit together with the press irons.

Additionally, in this case, since the upper segment of the supporting arm is turned around the vertical axis, it is possible to arrange efficiently the clamp devices against either the iron table or the heating iron without any troubles and any surplus operating mechanism.

Further, the turning device may be produced under a combination of a motor and a gear or the like, for example. In addition, in the present invention the turning device may be stored in the supporting arm.

In addition, as the finishing machine of the present invention for accomplishing the second problem, there is provided the machine shown in FIGS. 5 to 10. The operating mechanism for use in pushing a pair of forward and rearward press irons against the torso in the present invention is formed by a cylinder device arranged to be raised with its rod being faced upward, and a converter member fixed to the upper end of the rod of the cylinder device to convert an expanding or retracting operation of the rod into an advancing or retracting operation of the press machine. In the present invention, the converter member is formed with an engaging segment curved substantially in an S-shape. In addition, a roller arranged with its axis being laid at each of the supporting legs for the press irons is engaged with the engaging segment. The present invention is constructed such that as the converter member ascends, the press irons are cased to advance and in turn as the converter descends, the press irons are cased to be retracted.

In the case of the present invention, it is possible to simplify the operating machine for the press irons, form it by a small number of component parts and reduce a cost of their assembling or a cost of their manufacturing. Additionally, in accordance with the present invention, it is possible to reduce a weight of the device, make a small-sized device and save a space for it as well.

In the case of the present invention, the engaging segment is formed into a slit-like shape.

Because, with such an arrangement as above, it is possible to prevent the supporting segment for the press irons from being removed and guide it under a stable state.

Further, as shown FIGS. 9 and 10, in the present invention, the engagement segment may be formed at the circumferential edge of the front side of the converter member.

Because, in this case, it is possible to perform an advancing or retracting operation of the press irons by a vertical motion of the engagement segment.

Further, as a cover of the present invention installed at and used with the torso of the finishing machine, there is provided a cover formed as shown in FIGS. 11 to 15.

That is, the present invention is constructed such that a front suspension and a rear suspension put on the torso to cover a front side and a rear side of the torso are formed into one sheet; a loincloth-like cover segment wound around the rear side of the torso and having both ends connected thereto is formed at both lower sides of the front suspension; both upper sides of the front suspension and the rear suspension are provided with strings for binding the front suspension and the rear suspension and fixing them to the torso; the front suspension, the rear suspension and the loincloth-like cover segment are bent back at their peripheral positions to form the tubular bags; fastening strings for use in fastening the front suspension, the rear suspension and the loincloth-like cover segment to the torso through once operation are passed through the tubular bags; and hard members for use in holding a shape of the cover are arranged at both side positions of the loincloth-like cover segment; and there are provided fastening strings for fixing the loincloth-like cover segment to the side surface of the torso.

Further, the cover of the present invention can be put on the torso or put off from the torso by fastening or releasing each of the strings. Accordingly, application of the cover to be simplified and made fast.

PREFERRED EMBODIMENTS OF THE INVENTION

Figure 1:
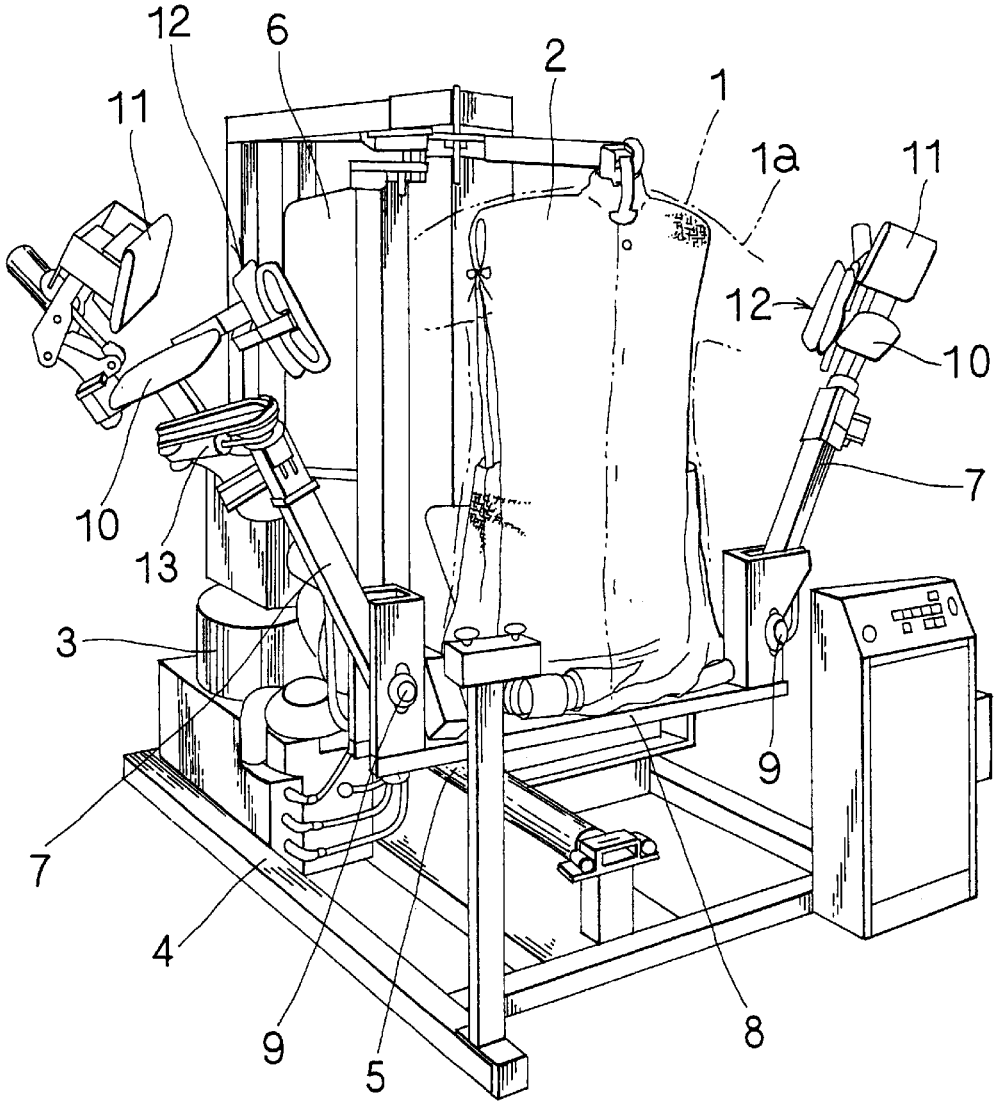
FIG. 1 is a perspective view showing one preferred embodiment of a finishing machine.

Referring now to the drawings, some preferred embodiments of the present invention will be described as follows.

In FIG. 1, etc., reference numeral 1 denotes a shirt such as a white-shirt, for example. Reference numeral 2 denotes a torso for use in wearing the shirt 1. The torso 2 is formed into a hollow shape and made such that hot air is supplied from a hot air supplying source 3 into a sleeve 1*a* of the shirt 1. In this preferred embodiment, each of the torsos 2 is installed at each of a front position and a rear position of a device main body 4, respectively, the torso is turned by 180° by a rotary driving device 5 installed at a lower part of the device main body 4 and then the torso is formed to be arranged alternatively at the front position and the rear position of the device main body 4.

Reference numeral 6 denotes a pair of front and rear press irons for use in press finishing the shirt 1 while pressing the front side and the rear side of the torso 2. The press irons 6 are installed at the rear side of the device main body 4 and formed such that they are heated with steam supplied inside the irons.

Reference numeral 7 denotes a pair of right and left supporting arms arranged at both sides of the above torso 2. The supporting arms 7 in this preferred embodiment are installed at both ends of a base frame 8 arranged in its upright raised state and the supporting arms are turned together with the torso 2. The supporting arms 7 are formed to be inclined in a lateral direction of the torso 2 or capable of being raised toward the torso 2 through pivot shafts 9 below them.

Figure 2:
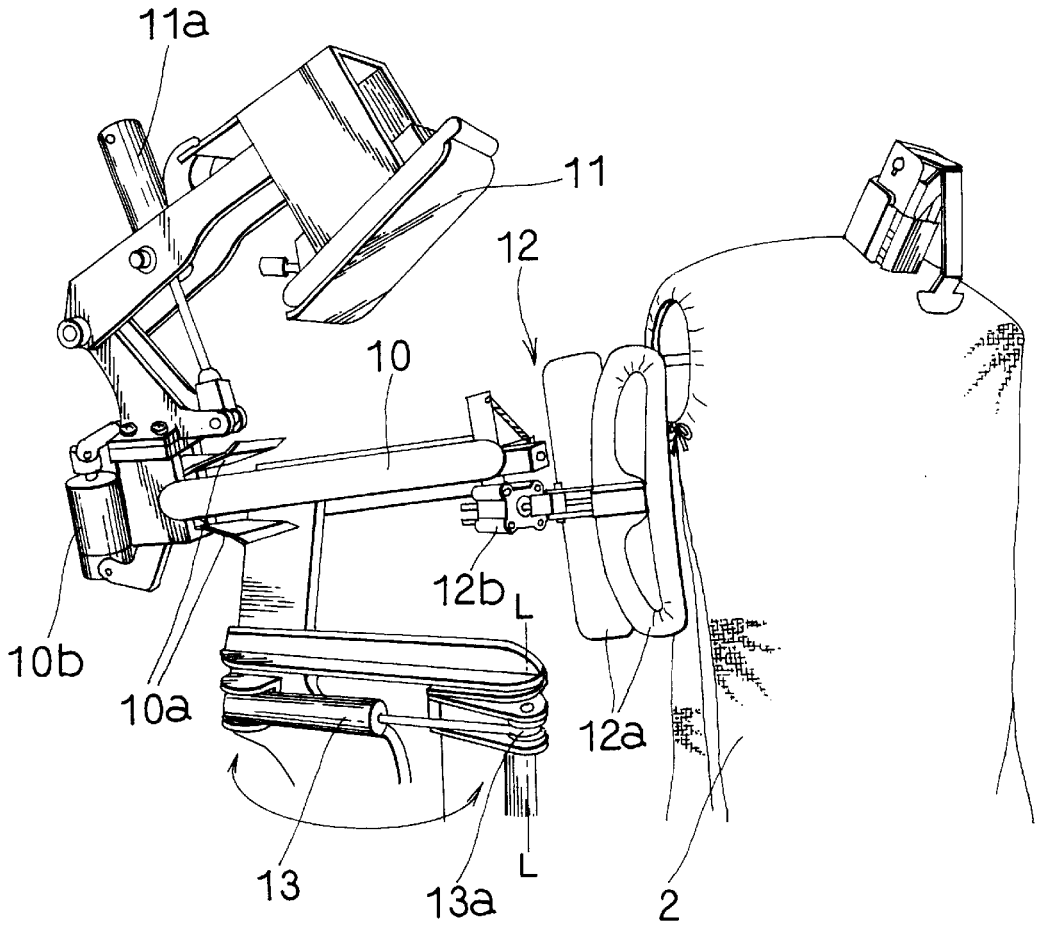
FIG. 2 is a perspective view showing a substantial part of the finishing machine.
Figure 3:
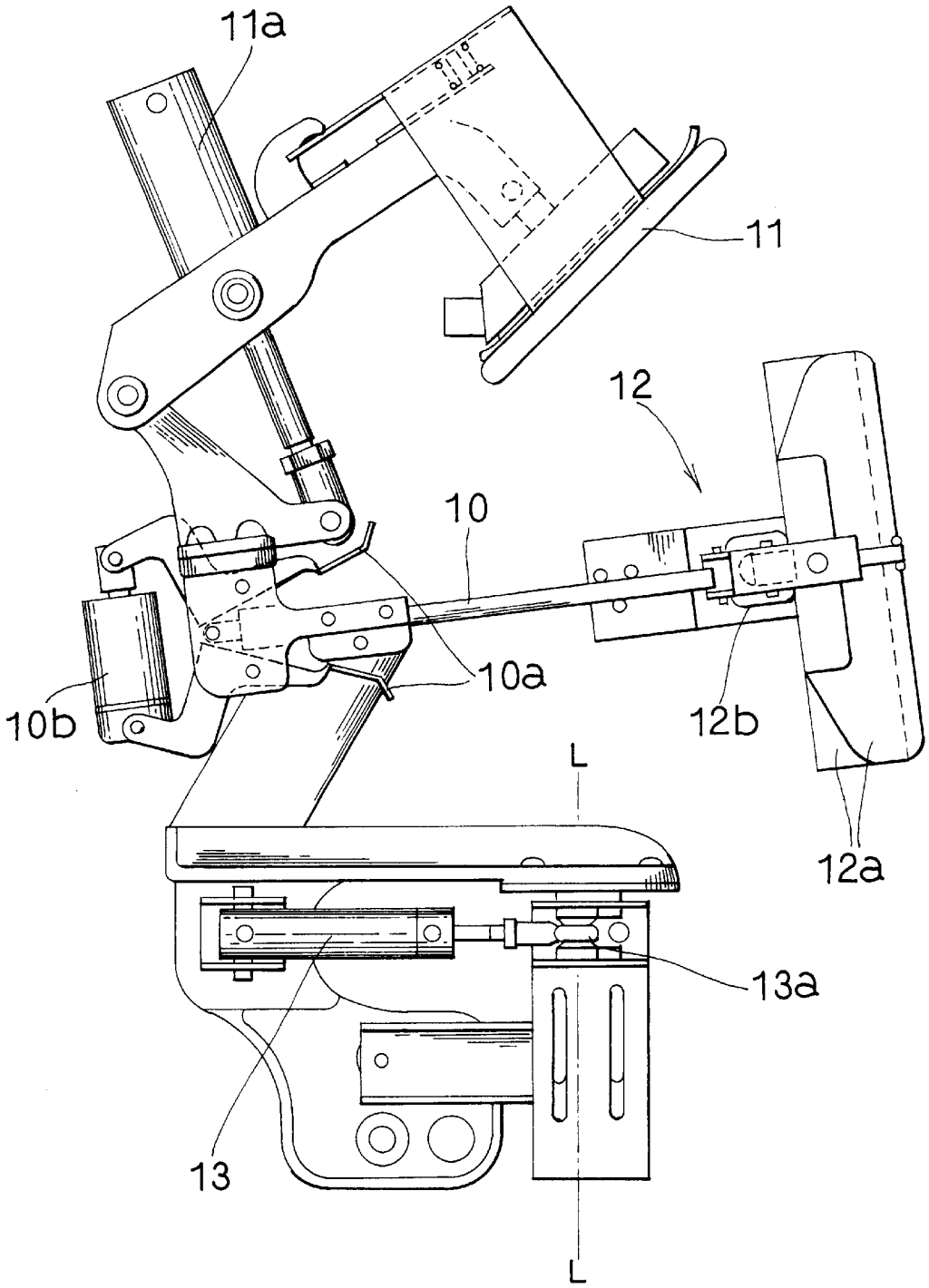
FIG. 3 is a front elevational view showing the substantial part of the finishing machine.

The supporting arm 7 is provided with, at its upper segment, an iron table 10 around which the sleeve of the shirt 1 is positioned and set, and a heating iron 11 for use in press finishing both a tuck and a cuff of the shirt sleeve. As shown in FIGS. 2 and 3, etc., the iron table 10 is provided with holders 10*a* for holding and fixing the sleeve of the shirt 1. Reference symbol 10*b* denotes an air cylinder for use in opening or closing the holders 10*a*. Reference symbol 11*a* denotes an air cylinder for use in pressing the heating iron 11 against the iron table 10.

The supporting arm 7 is formed such that it is provided with, at its upper part, a clamp device 12 for use in holding and fixing the sleeve of a short-sleeve shirt 1 together with the iron table 10, etc. This clamp device 12 is formed by a pair of holding members 12*a* and an air cylinder 12*b* for use in opening or closing the holding members 12*a*. The holding members 12*a* are arranged substantially perpendicular to the longitudinal direction of the iron table 10. With such an arrangement as above, the sleeve of the short-sleeve shirt 1 is held by the holding members 12*a* from the forward direction and the rearward direction of the device main body 4.

Figure 4:
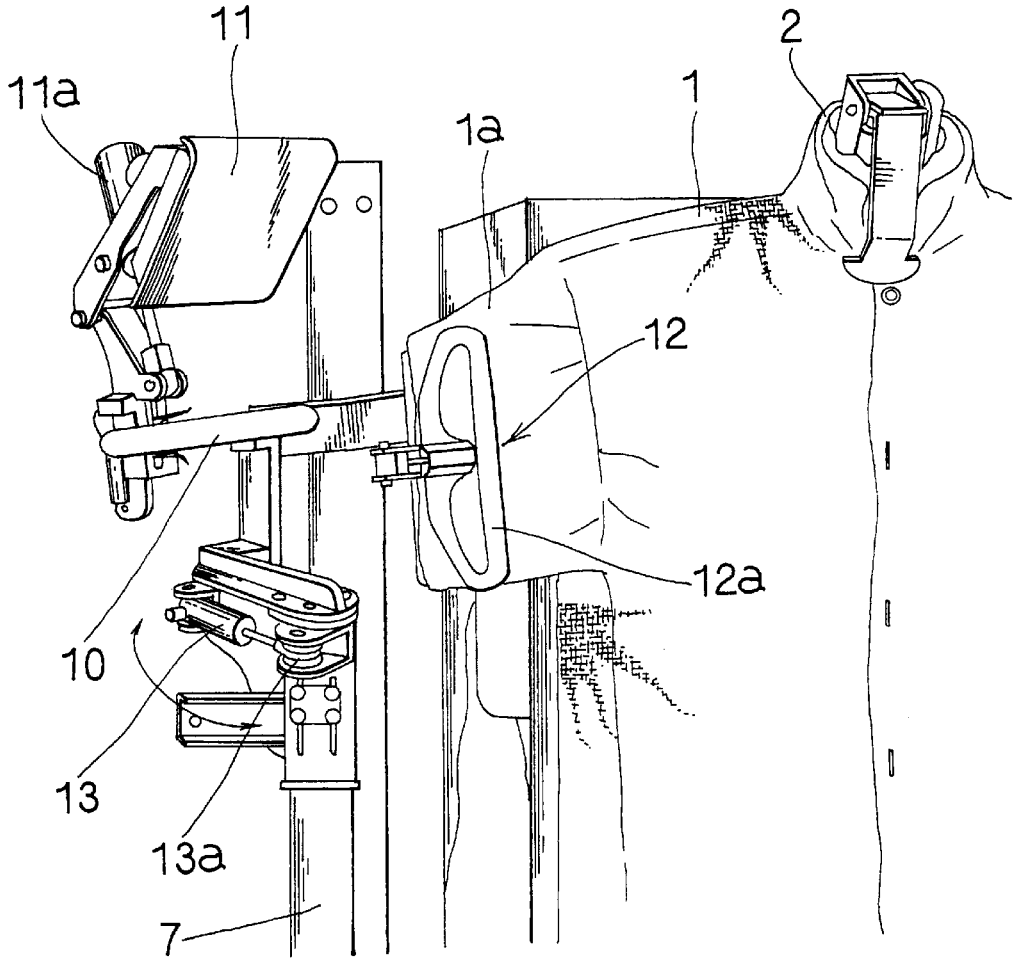
FIG. 4 is a perspective view showing the substantial part of the finishing machine while it is being used.

The upper part of the supporting arm 7 is formed such that it can be turned in a predetermined angle by a turning device 13 around a vertical shaft L along the supporting arm 7 as shown in FIG. 2, etc. According to the length of the sleeve of shirt 1 (i.e. short-sleeve or long-sleeve), this turning device 13 is used for arranging either the iron table 10 etc. or the clamp device 12 at the most-suitable position against the torso 2. In this case, since the entire of the upper part of the supporting arm 7 is turned by the turning device 13, the present invention shows some effects that the clamp device 12 does not become a hindrance when a long-sleeve shirt 1 is to be finished and the iron table 10 can be installed at a rear side of the device main body 4 when a short-sleeve shirt 1 is to be finished, resulting in that it produces a superior workability. In the case of this preferred embodiment, the air cylinder acting as the turning device 13 is arranged perpendicular to the supporting arm 7 at the upper part of the supporting arm 7 as shown in FIGS. 2 to 4. Then, as a rod of the air cylinder acting as the turning device 13 extends, the upper part of the supporting arm 7 is turned only by a predetermined angle in a rearward direction of the device main body 4 around a pivot segment 13*a* at the extremity end of the rod acting as a vertical shaft L. With such an arrangement as above, the clamp device 12 is arranged to be oppositely faced against the side part of the torso 2 to enable the sleeve end of the short-sleeve shirt 1 to be held from the forward or rearward direction of the device main body 4 as shown in FIG. 4.

An action of the present invention in regard to this preferred embodiment will be described as follows.

At first, in the case that the long-sleeve shirt 1 is to be finished by an operator, the shirt 1 is applied to cover the torso 2 under a state in which the supporting arms 7 are inclined in side directions as shown in FIG. 1. Next, the operator raises the supporting arms 7, places the sleeve ends of the shirt 1 around the iron tables 10 to cover them and then holds the sleeve ends by the holders 10*a*. Under this state, the heating irons 11 are turned to cause the tucks and cuffs to be press finished.

Under this state, the front side torso 2 is turned to the rear side of the device main body 4 and arranged between the press irons 6. At this time, the rear side torso 2 is turned forwardly and arranged at the front side of the device main body 4. As the torso 2 is turned to the rear side, the supporting arms 7 are inclined to the side of the torso 2 and hot air is supplied from the hot air supplying source 3 into the sleeves 1*a*. With such an operation as above, the sleeves 1*a* are bulged out and finished in tension.

In addition, the press irons 6 press against the torso 2 to cause the front side and the rear side of the shirt 1 to be finished in press. At this time, the operator puts off the press finished shirt 1 from the torso 2 arranged at the front side and puts a new non-finished shirt 1 onto the torso 2.

Next, an operation for finishing the short-sleeve shirt 1 will be described. P In this case, at first, the operator extends the rod of the air cylinder acting as the turning device 13. With such an operation as above, the upper segments of the supporting arms 7 are turned around the vertical shaft L of the pivot segment 13*a* in a rearward direction of the device main body 4. As a result, the clamp device 12 is oppositely arranged at the side part of the torso 2. Next, the operator inserts the sleeve ends of the short-sleeve shirt 1 between the holder members 12*a*, extends the rod of the air cylinder 12*b* and holds them. After this operation, in the present invention hot air is supplied into the sleeve 1*a* of the short-sleeve shirt 1 and the sleeve 1*a* is finished in tension. The front side and the rear side of the short-sleeve shirt 1 are finished in press under the same order as that of the long-sleeve shirt 1.

Next, referring to FIG. 1 and FIGS. 5 to 10, one preferred embodiment of the present invention defined in claim 3 will be described as follows. The same locations and the same members as those of the aforesaid preferred embodiment are denoted by the same reference symbols and their detailed description will be eliminated.

This preferred embodiment of the present invention is formed such that there are provided the torso 2 for putting on the shirt 1, a pair of front and rear press irons 6 for use in pressing the front side and the rear side of the torso 2 to press finish the shirt 1, and a pair of right and left supporting arms 7 arranged at both sides of the aforesaid torso 2 in the same manner as that of the aforesaid preferred embodiment. The upper segment of the supporting arm 7 is provided with the iron table 10 around which the sleeve end of the long-sleeve shirt 1 is positioned and set, and with the heating iron 11 for use in press finishing the tuck and the cuff of the shirt sleeve. The sleeve 1*a* of the shirt 1 is bulged out with hot air supplied from the hot air supplying source 3 through the inside part of the torso 2 and finished in tension.

The aforesaid torso 2 is arranged at both front side and rear side of the device main body 4 in the same manner as that of the aforesaid preferred embodiment and formed such that they are turned by 180° and alternatively arranged at front side and rear side positions of the device main body 4. The press irons 6 are arranged at the rear side of the device main body 4. The supporting segment 6*a* for the press irons 6 is pivoted at its lower end to the device main body 4 and the supporting segment 6*a* is formed such that it can be turned around the pivoted location 14 in a forward or rearward direction of the device main body 4. The press irons 6 are formed such that they are moved in parallel by a link device 15.

Figure 5:
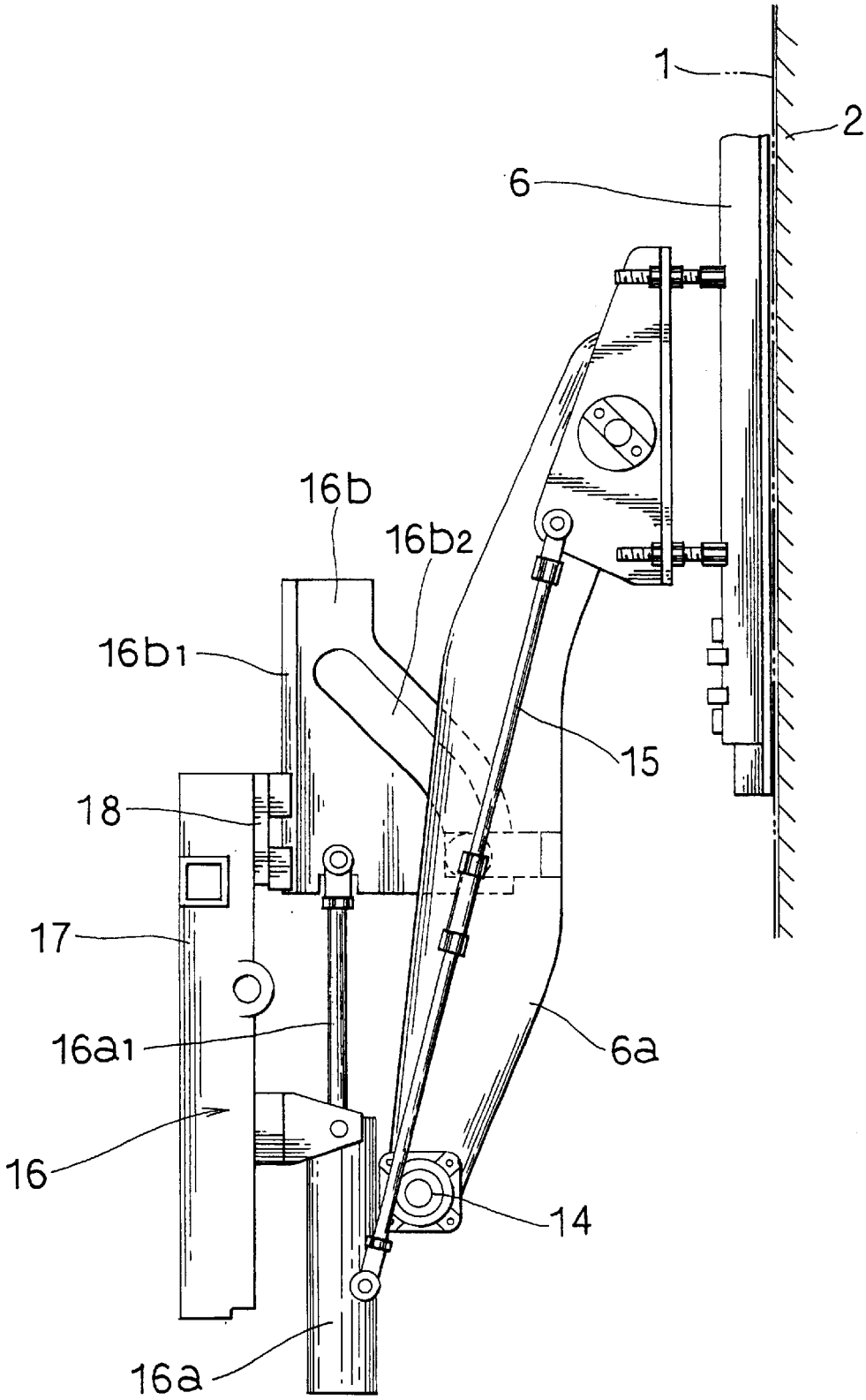
FIG. 5 is a side elevational view showing the substantial part of an operating mechanism of a press iron.

In FIG. 5, etc., reference numeral 16 denotes an operating mechanism for use in pressing the aforesaid press irons 6 against the torso 2. This operating mechanism 16 is comprised of a cylinder device 16*a* raised with the rod 16*a*1 being set in upside, and a converter member 16*b* fixed to the upper end of the rod 16*a*1 of the cylinder device 16*a* to convert an extending or retracting operation of a rod 16*a*1 into an advancing or retracting motion of press irons 6.

The aforesaid cylinder device 16*a* in this preferred embodiment is constituted an air cylinder. The converter member 16*b* has at its rear side a rail 16*b*1 fixed in a vertical manner. This rail 16*b*1 is engaged with a guide block 18 fixed to a supporting column 17 and the converter member 16*b* is formed such that it is guided by the guide block 18 and ascends or descends through extending or retracting operation of the rod 16*a*1 of the cylinder device 16*a*.

The aforesaid converter member 16*b* is formed a slit-like engaging segment 16*b*2 curved substantially in a S-shape. A roller 19 is engaged with the engaging segment 16*b*2. A roller 19 is provided with the supporting segment 6*a* with the shaft 19*a* being laid. Thus, the engaging segment 16*b*2 causes the press irons 6 to be moved forward (refer to FIG. 5) when the converter member 16*b* ascends together with the rod 16*a*1 of the cylinder device 16*a*, and further causes the press irons 6 to be retracted when the converter member 16*b* descends.

Figure 6:
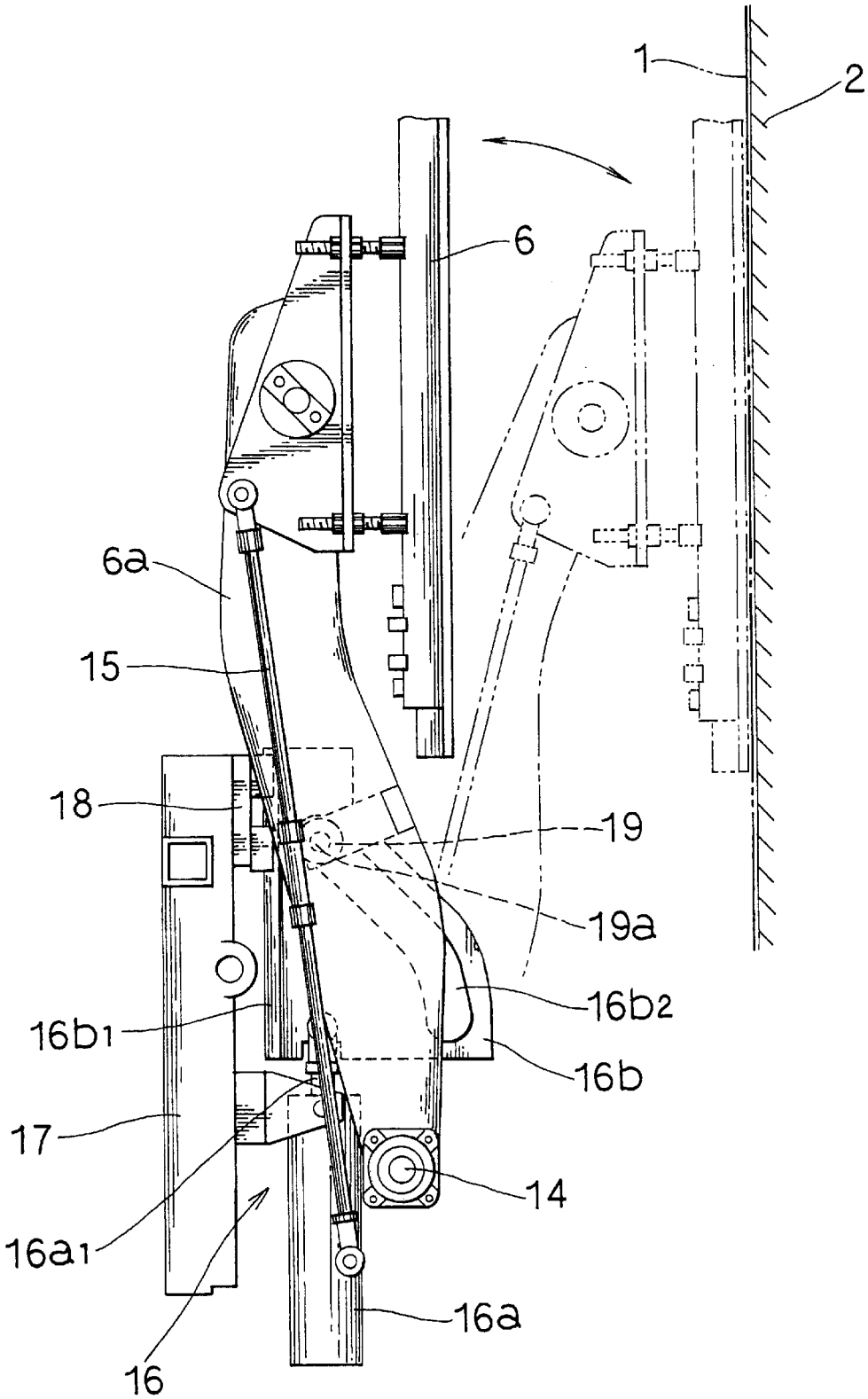
FIG. 6 is a side elevational view showing the substantial part to illustrate an action of the operating mechanism of the press iron.
Figure 7:
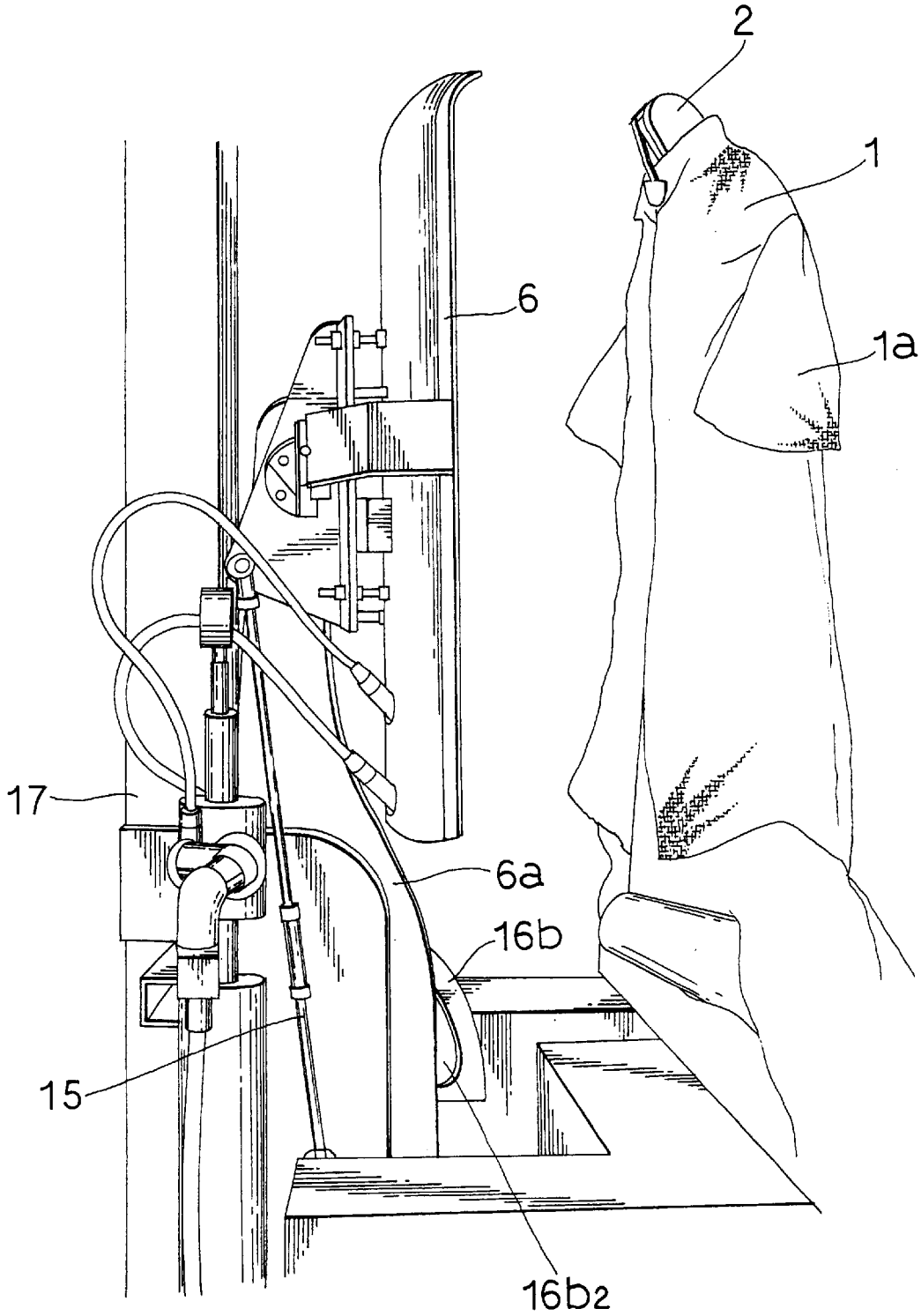
FIG. 7 is a perspective view showing the substantial part of the finishing machine.
Figure 8:
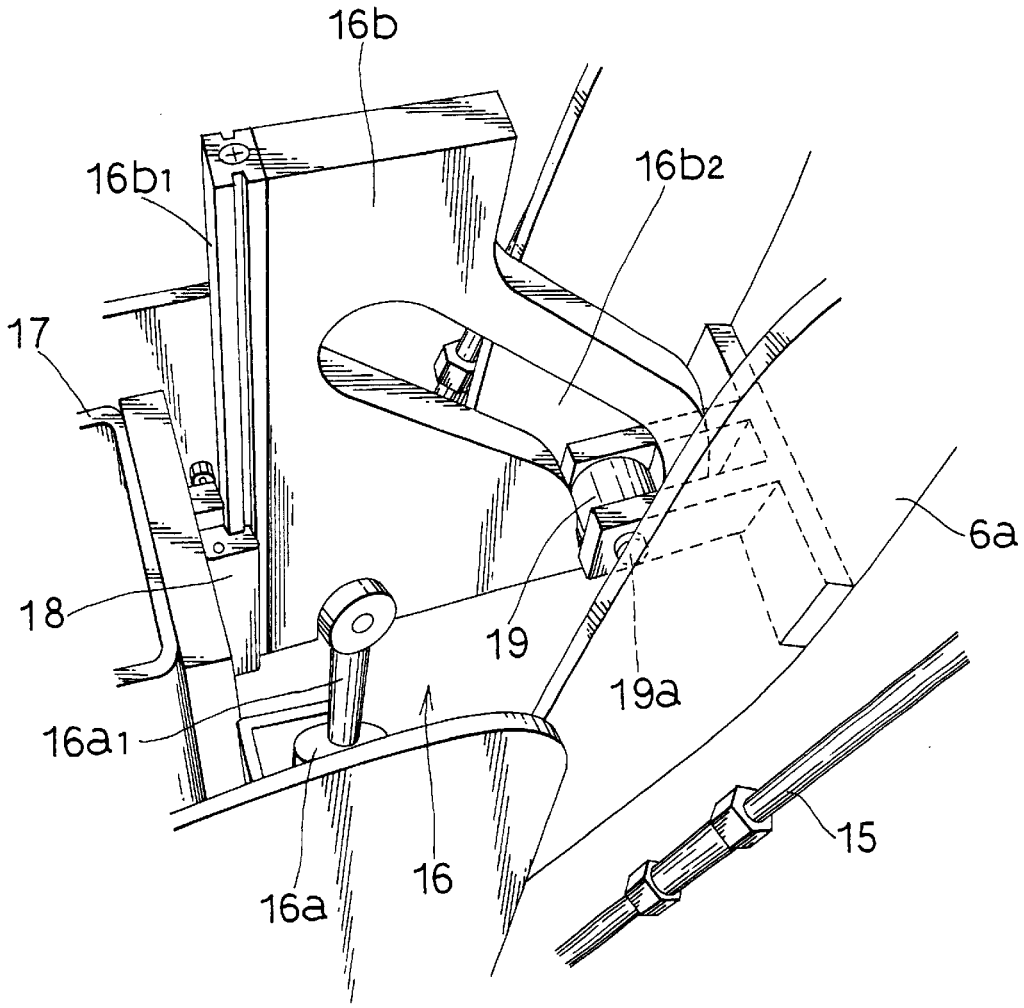
FIG. 8 is a perspective view showing the substantial part of the operating mechanism of the press iron.

Next, referring to FIGS. 5 and 6, etc., action of the present invention will be described as follows.

At first, the torso 2 is turned rearward of the device main body 4 and arranged between a pair of press irons 6. Then, the operating mechanism 16 is driven to cause the front side and the rear side of the shirt 1 to be press finished. More practically, the rod 16*a*1 of the cylinder device 16*a* extends to cause the converter member 16*b* to be ascended (refer to FIG. 5). Then, the supporting leg 6*a* for the press irons 6 is guided by the engaging segment 16*b*2 and turned forwardly around the pivoted location 14. With such an arrangement as above, the press irons 6 move forward to press against the torso 2. As the rod 16*a*1 of the cylinder device 16*a* is retracted, the supporting leg 6*a* for the press irons 6 is guided by the engaging segment 16*b*2 and turned rearward as shown in FIG. 6, and arranged in its raised state. As a result, the press irons 6 are pulled away from the torso 2 and retracted.

In view of the aforesaid arrangement, as the aforesaid engaging segment 16*b*2 in the present invention is not limited to the slit-like shape. That is, as shown in FIGS. 9 and 10 the engaging segment 16*b*2 is the circumferential edge of the converter member 16*b* curved like a substantially in a S-shape and further may be formed to be engaged with a roller 19 arranged at the supporting leg 6*a* for the press irons 6.

Figure 9:
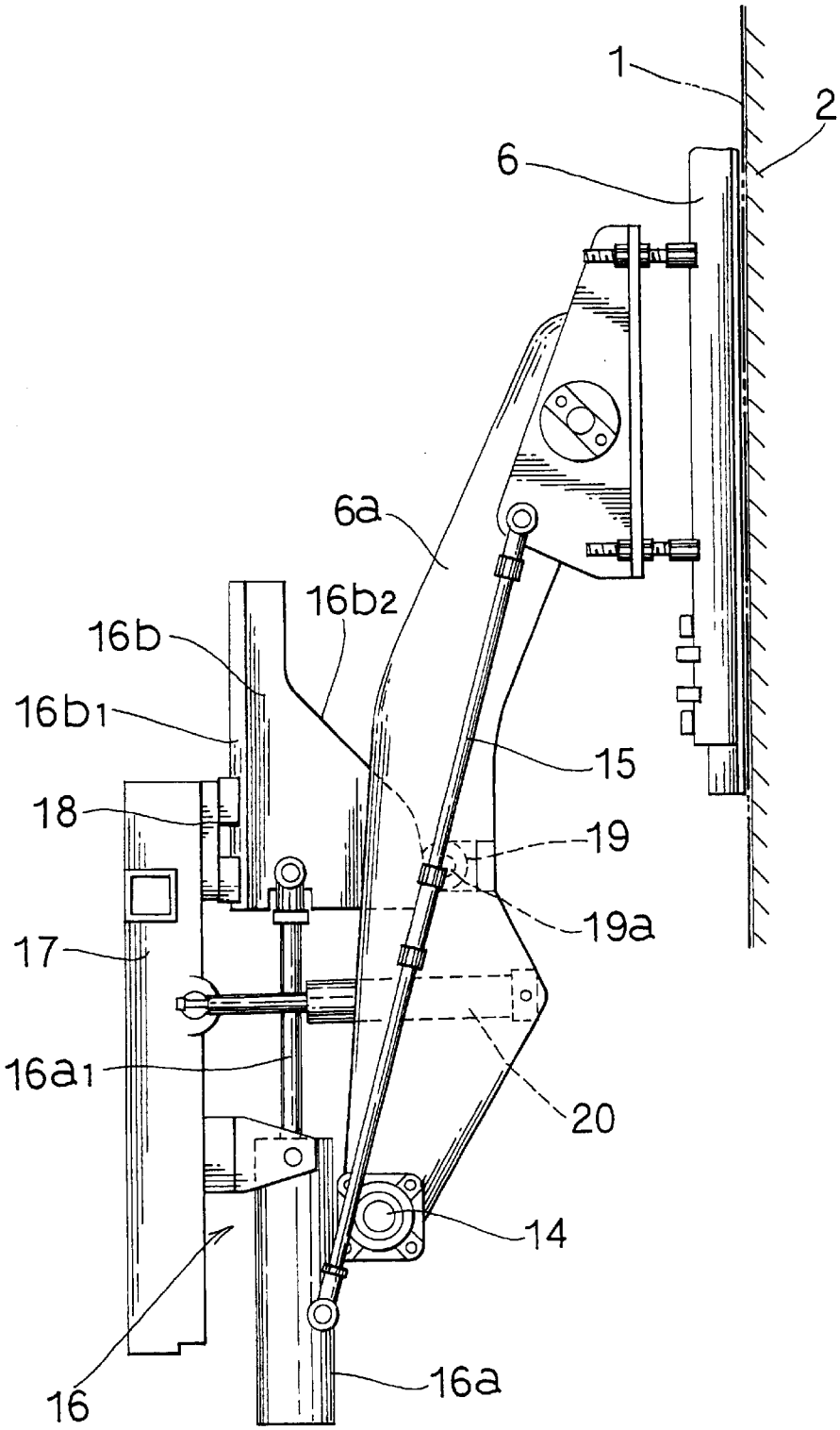
FIG. 9 is a side elevational view showing a substantial part to illustrate another preferred embodiment of the operating mechanism of the press iron.
Figure 10:
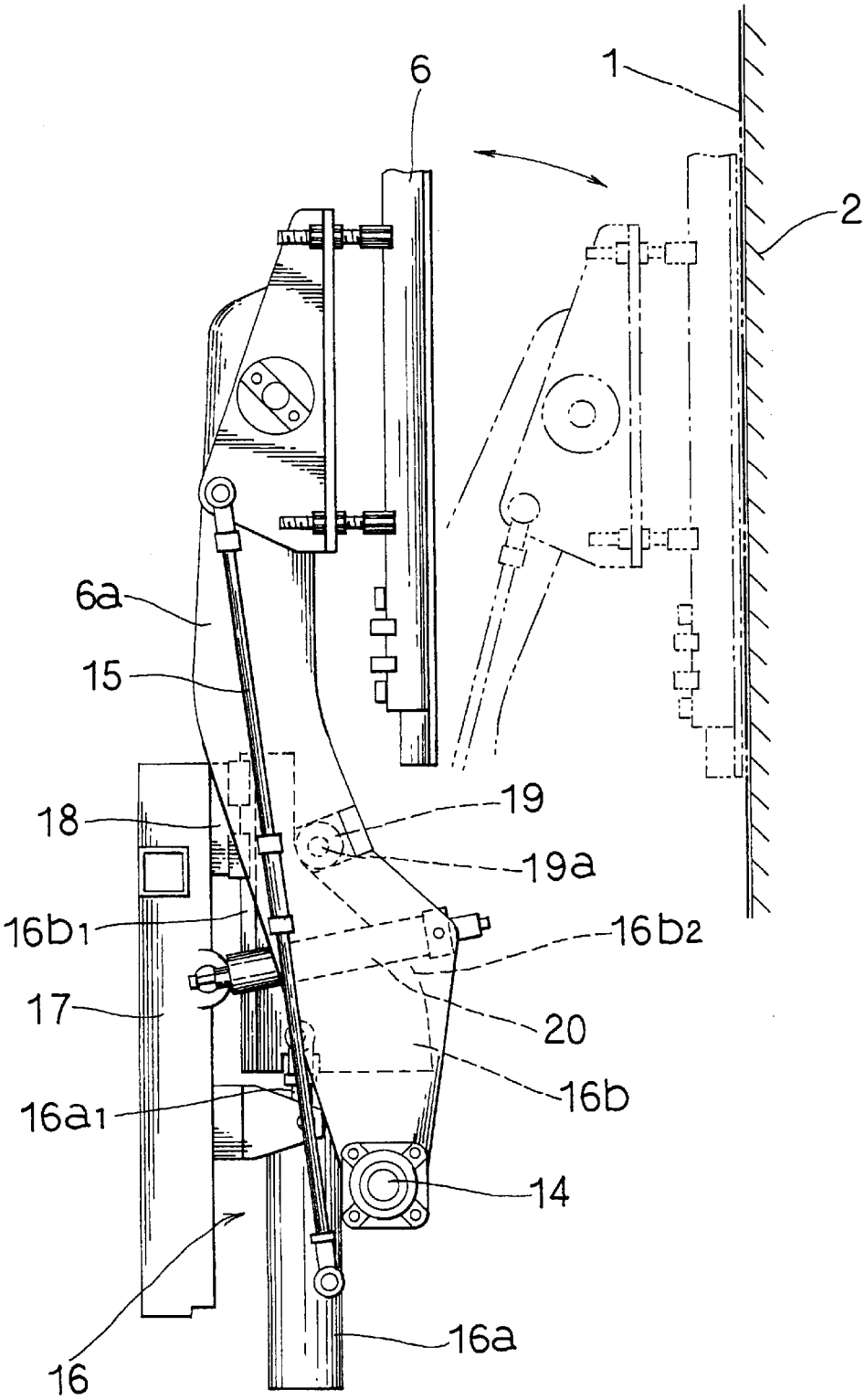
FIG. 10 is a side elevational view showing a substantial part to illustrate an action of the preferred embodiment in FIG. 9.

In FIGS. 9 and 10, reference numeral 20 denotes a cylinder bridged between the supporting leg 6*a* for the press irons 6 and the supporting column 17. The supporting leg 6*a* is assured to its turning operation in forward and rearward directions without being fallen forward by extending or retracting the rod of the cylinder 20. The pressing operation of the press irons 6 is carried out in the same manner as that of the aforesaid example. That is, as the rod 16*a*1 of the cylinder device 16*a* extends, the supporting leg 6*a* for the press irons 6 is guided by the engaging segment 16*b*2 at the circumferential edge of the converter member 16*b* and is turned forward around the pivoted location 14. Then, with such an operation as above, the press irons 6 move forward to press against the torso 2 and to press finish the front side and the rear side of the shirt 1.

In addition, as the rod 16*a*1 of the cylinder device 16*a* is retracted, the supporting leg 6*a* for the press irons 6 is turned rearward and raised. As a result, the press irons 6 are pulled away from the torso 2 and this state will be moved back.

Referring to FIGS. 11 to 15, a cover for use in covering the torso 2 will be described. The same members and the same locations as those of the aforesaid example are denoted by the same reference symbols and their detailed description will be eliminated.

The cover of the present invention is made such that a front suspension 21 and a rear suspension 22 applied to the torso 2 to cover the front side and the rear side of it are formed into a sheet. Reference numeral 23 denotes an opening passed through the neck part of the torso 2. In addition, reference numeral 24 denotes a loincloth-like cover wound around a rear side of the torso 2 where both ends are connected by a fastener 25, for example. This cover 24 is sawn to both sides at the lower part of the front suspension 21, for example.

Reference numeral 26 denotes strings arranged at both upper sides of the aforesaid front suspension 21 and rear suspension 22. The strings 26 are arranged such that their ends are released to open and at the same time their heights are aligned to each other in such a way that the string 26 arranged at the upper part of the front suspension 21 and the string 26 arranged at the upper part of the rear suspension 22 can be bound to each other.

Figure 11:
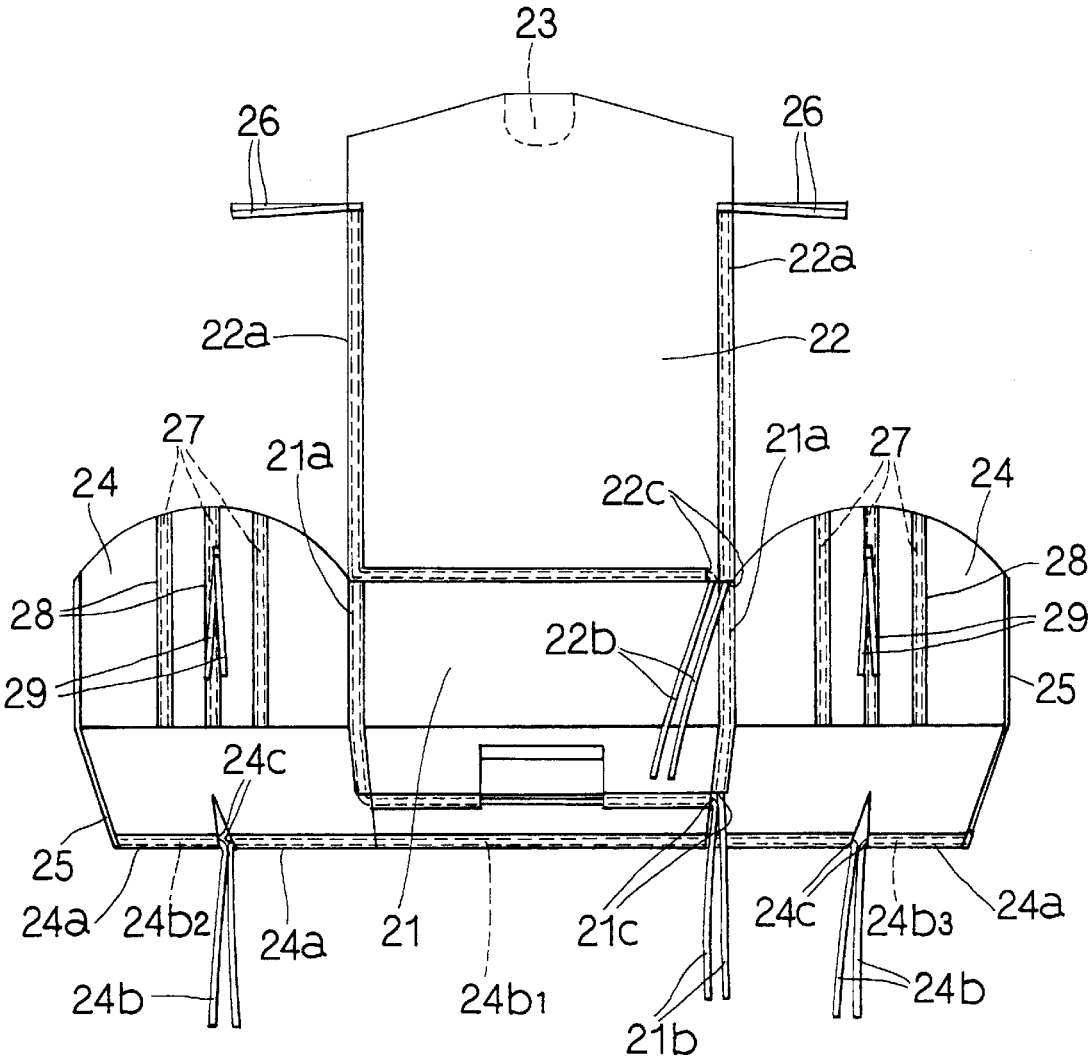
FIG. 11 is a rear view showing a state in which a part of a cover of the present invention is unfolded.
Figure 12:
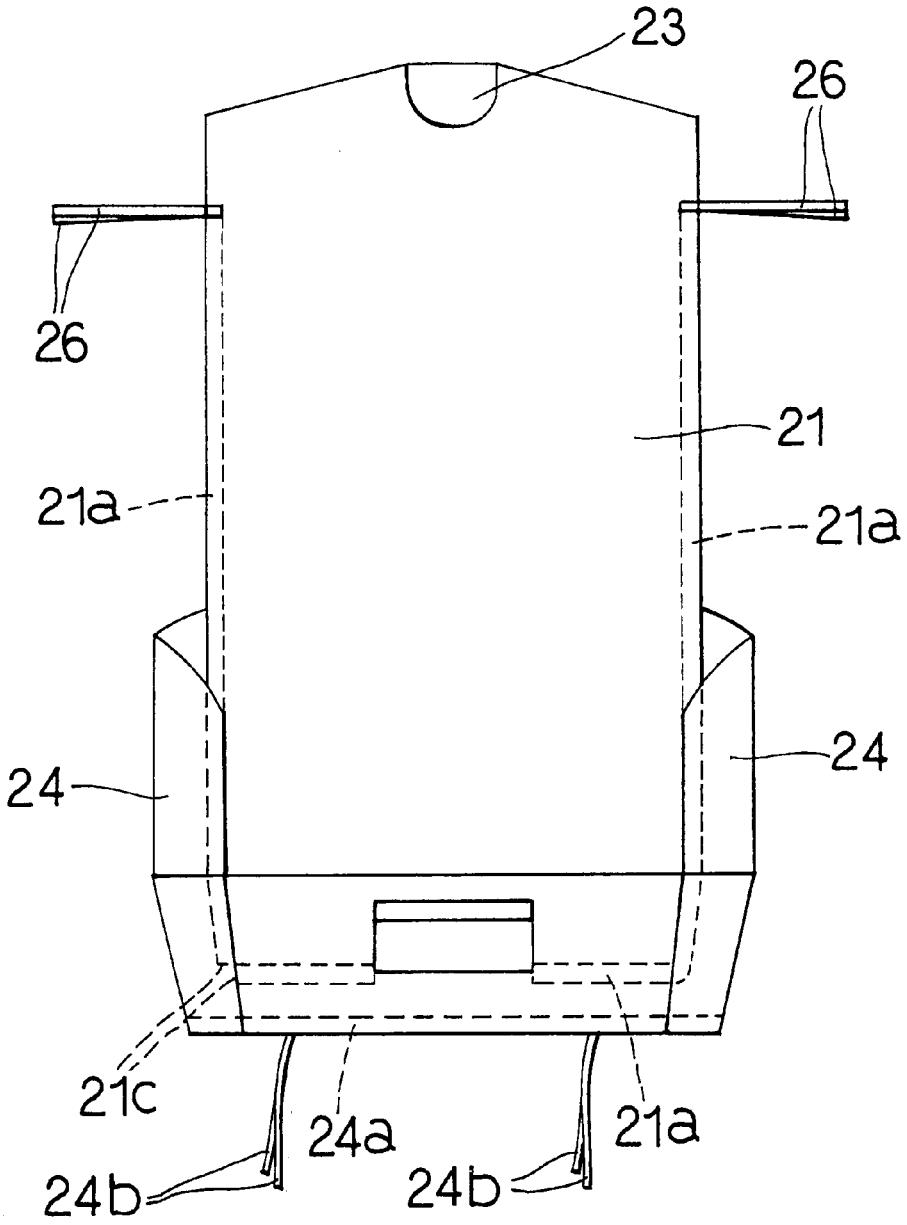
FIG. 12 is a front elevational view showing the cover of the present invention.
Figure 13:
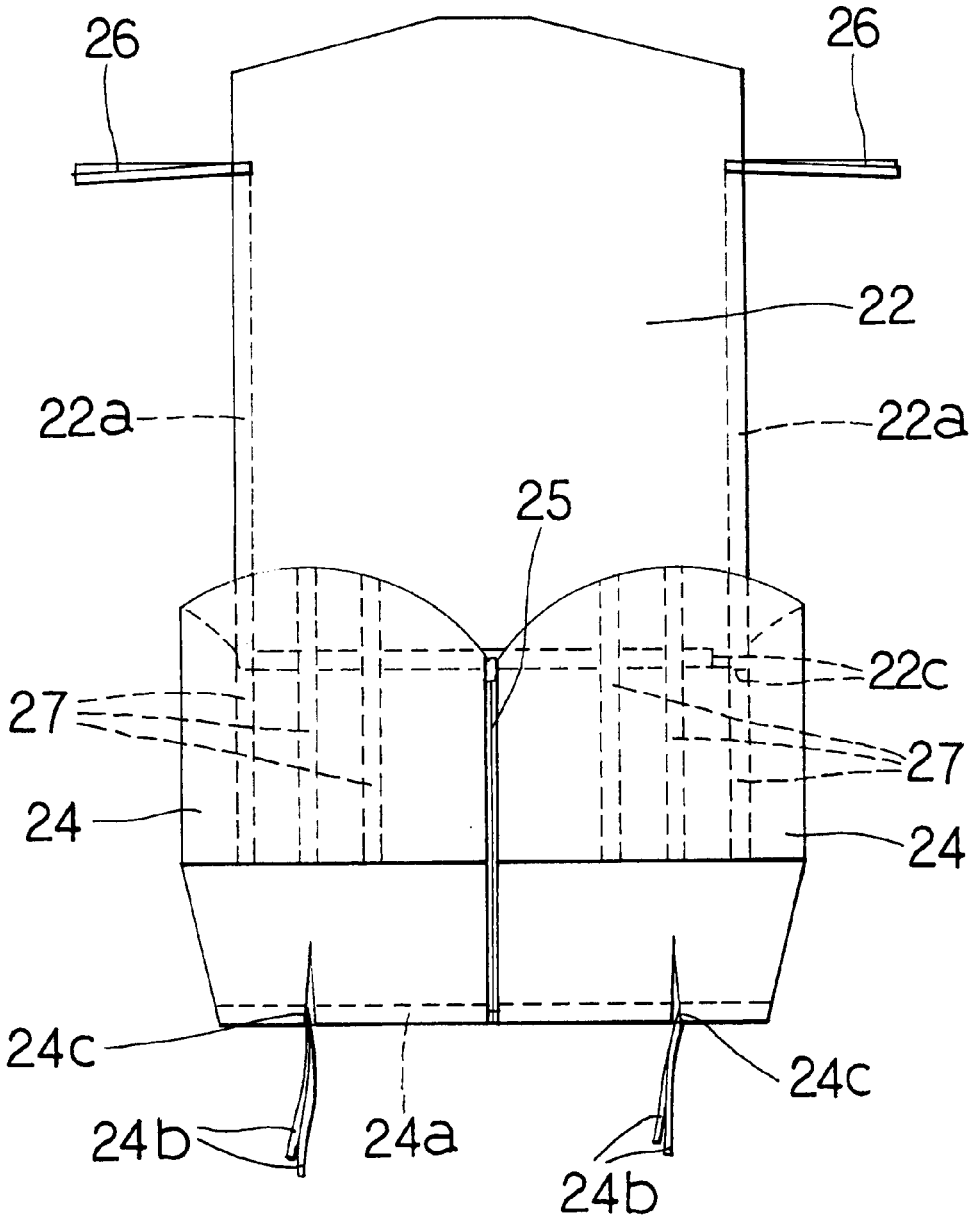
FIG. 13 is a back view showing the cover of the present invention.
Figure 14:
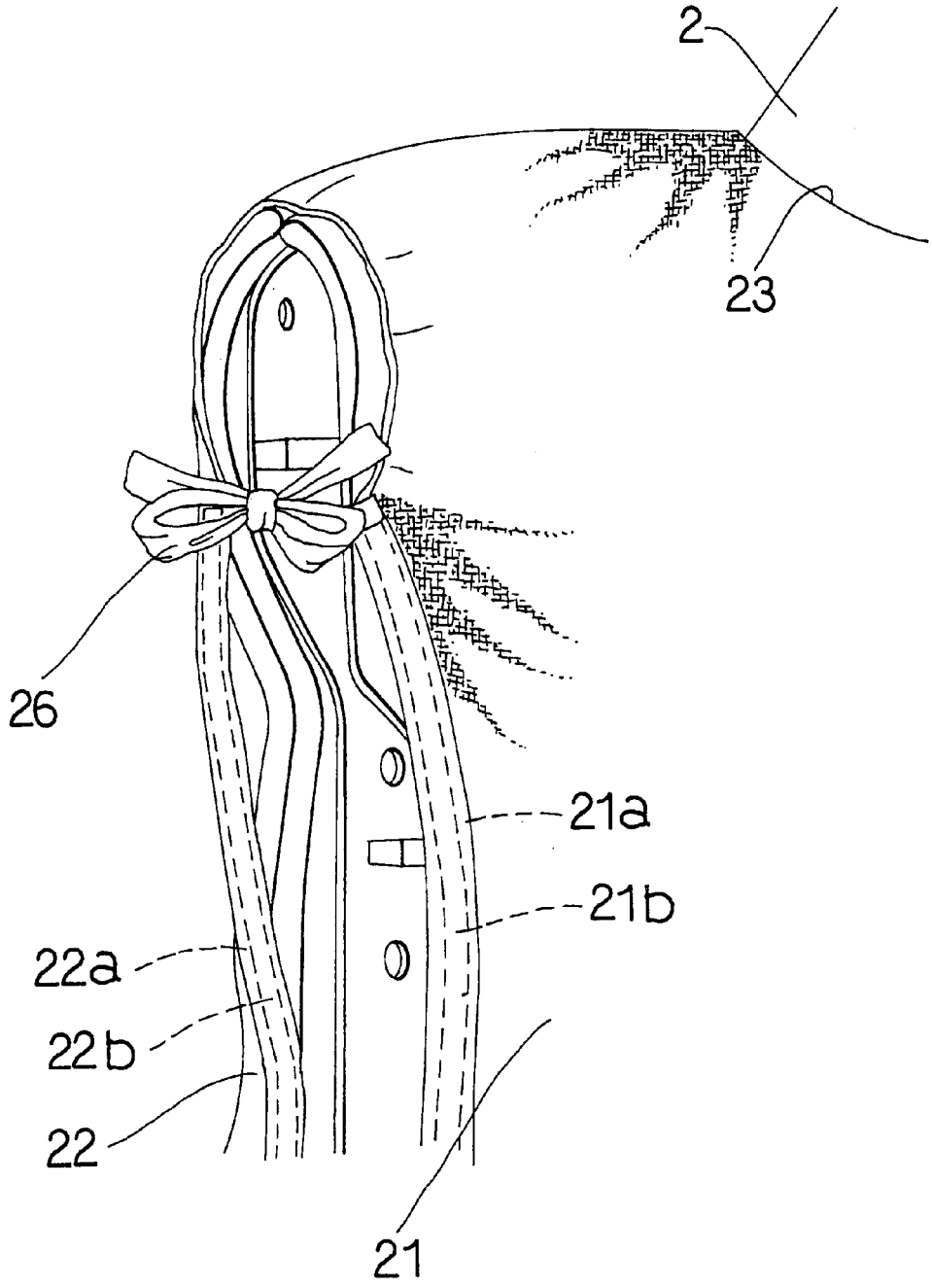
FIG. 14 is a perspective view showing a substantial part illustrating use of the cover of the present invention.
Figure 15:
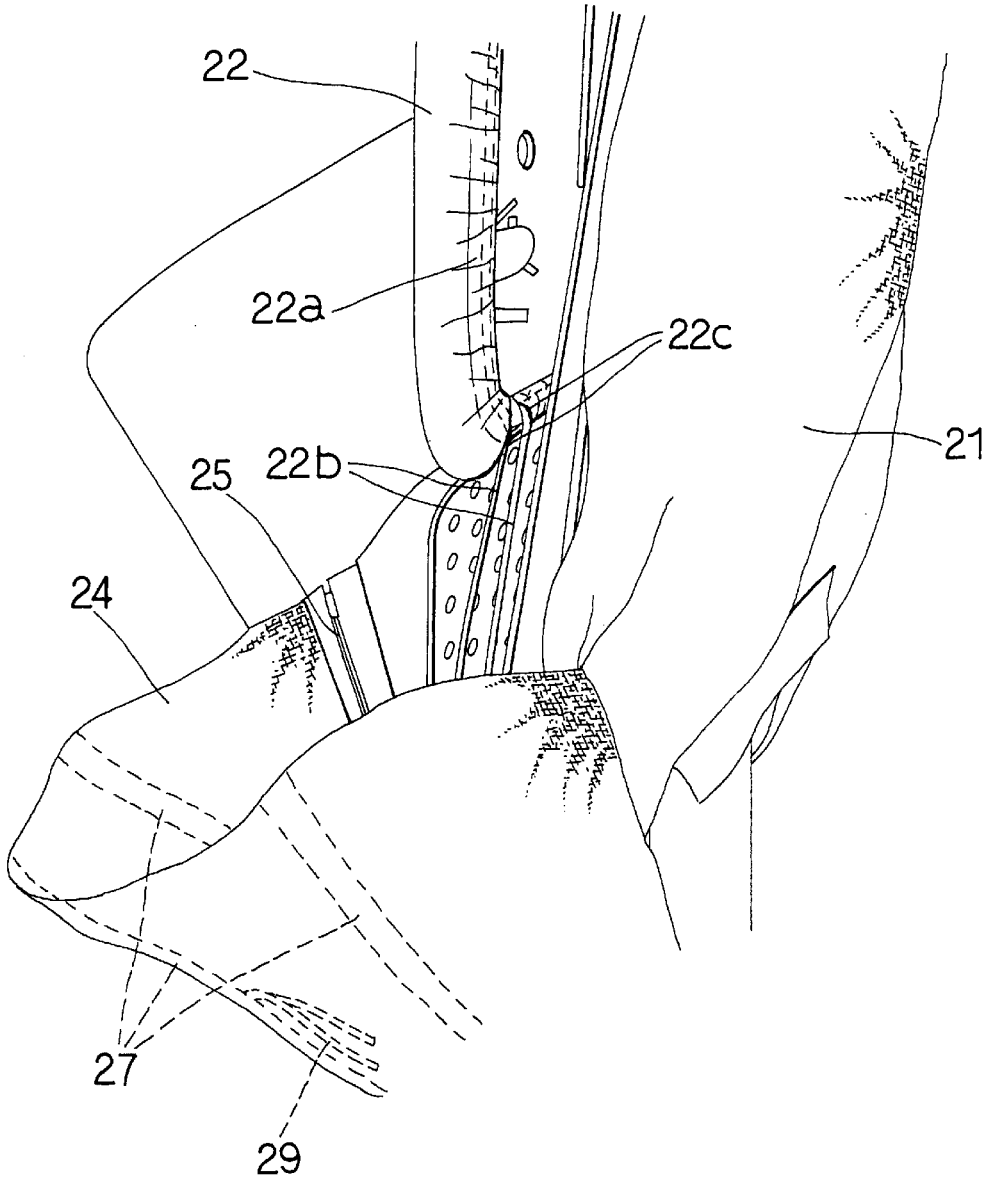
FIG. 15 is a perspective view showing a substantial part illustrating use of the cover of the present invention.

Additionally, each of the front suspension 21, rear suspension 22 and loincloth-like cover 24 is formed such that each of them is bent back at their circumferential positions and is provided with tubular bags 21*a*, 22*a* and 24*a*, respectively. Then, the present invention is constructed such that the fastening strings 21*b*, 22*b* and 24*b* for use in fastening through once operation the front suspension 21, rear suspension 22 and loincloth-like cover 24 against the torso 2 are passed through the tubular bags 21*a*, 22*a* and 24*a*. The fastening strings 21*b*, 22*b* and 24*b* for the front suspension 21 and the rear suspension 22 are constituted by two strings, one passing in a vertical direction and the other passing from a vertical direction to a lateral direction in a L-shape form. Further, the fastening string 24*b* passed through the bag 24*a* of the loincloth-like cover 24 in FIG. 11 is constituted by a total number of three of the fastening string 24*b*1 at the central position, the fastening strings 24*b*2 and 24*b*3 arranged at the right and left sides of the central position. These fastening strings 24*b*1, 24*b*2 and 24*b*3 are operated such that their end segments are drawn out of an opening 24*c* formed at a proper position of the tubular bag 24*a* and their adjoining end segments are fastened to each other.

In addition, the cover of the present invention is made such that hard members 27 for use in holding a shape of the cover are arranged at both side positions of the loincloth-like cover 24. This hard member 27 in this preferred embodiment is made of a metallic rod and covered by the cover cloth 28 and at the same time a total number of three hard members in a vertical direction are equally spaced apart in a lateral direction.

Reference numeral 29 denotes a fastening string for use in fixing the loincloth-like cover 24 against the side surface of the torso 2. Each of a pair of the fastening strings 29 in this preferred embodiment is arranged while their end segments are being opened at the inner surface positions of both sides of the loincloth-like cover 24.

Next, one example in the case that the cover of the present invention is installed at the torso 2 will be described as follows.

At first, an operator applies the product of the present invention to the torso 2 and fastens the strings 26 at both sides of the front suspension 21 and the rear suspension 22. Next, the operator arranges the bag segments 21*a*, 22*a* of the front suspension 21 and the rear suspension 22 inside the circumference of the torso 2, draws the end segments of the fastening strings 21*b*, 22*b* and fastens them. In addition, the operator applies the bag segment 24*a* of the loincloth-like cover 24 at the proper position of the base frame 8 having the torso 2 fixed thereto, draws the end segments of the fastening string 24*b* and fastens them. After this work, the operator fastens the fastening string 29 at the proper position in the side surface of the torso 2 and fixes both sides of the loincloth-like cover 24 to the torso 2. In the case that the product of the present invention is to be removed, the operation should be performed in a reverse order to that described above.

What is claimed is:

1. A shirt finishing machine comprising:

a torso on which a shirt is put;

a pair of front and rear press irons for pressing against a front side and a rear side of the torso to press finish the shirt; and a pair of right and left supporting arms arranged at both sides of the torso, wherein the upper segments of the supporting arms are provided with an iron table around which a sleeve of the shirt is positioned and set, and with a heating iron for use in press finishing the tuck and the cuff of the shirt sleeve, and hot air is supplied into the sleeve of the shirt to finish it in tension; and the upper segments of the supporting arms are provided with clamp devices for use in holding the sleeve end of a short-sleeve shirt and fixing it and the supporting arms are provided with a turning device for turning the upper segments of the supporting arms having the clamp devices and oppositely arranging the clamp devices at side segments of the torso, wherein the turning device is formed by an air cylinder arranged at the upper segment of the supporting arm and the upper segment of the supporting arm is formed to be turned around its vertical axis along the supporting arm.

2. A shirt finishing machine comprising:

a torso on which a shirt is put;

a pair of front and rear press irons for pressing against a front side and a rear side of the torso to press finish the shirt; and a pair of right and left supporting arms arranged at both sides of the torso, wherein the upper segments of the supporting arms are provided with an iron table around which a sleeve of the shirt is positioned and set, and with a heating iron for use in press finishing the tuck and the cuff of the shirt sleeve, and hot air is supplied into the sleeve of the shirt to finish it in tension, and an operating mechanism for use in pressing the press irons against the torso is comprised of a cylinder device arranged to be raised with its rod being faced up and a converter member fixed to the upper end of the rod of the cylinder device to convert an extending or retracting operation of the rod into an advancing or retracting operation of the press irons, and the converter member is formed with an engaging segment curved substantially in a S-shape, the engaging segment is engaged with a roller arranged with its axis being laid at the supporting legs for the press irons and is formed such that when the converter member ascends, the engaging segment advances the press irons, and when the converter member descends, the engaging segment retracts the press irons.

3. A shirt finishing machine as claimed in claim 2, wherein the engaging segment is formed into a slit-like shape.

4. A shirt finishing machine as claimed in claim 2, wherein the engaging segment is formed at a circumferential edge of front side of the converter member.

5. A shirt finishing machine as claimed in claim 1, wherein the torso includes a front suspension and a rear suspension put on the torso to cover a front side and a rear side of the torso are formed into one sheet;

a loincloth-like cover segment wound around the rear side of the torso and having both ends connected thereto is formed at both lower sides of the front suspension;

both upper sides of the front suspension and the rear suspension are provided with strings for binding the front suspension and the rear suspension and fixing them to the torso;

the front suspension, the rear suspension and the loincloth-like cover segment are bent back at their peripheral positions to form the tubular bags;

fastening strings for use in fastening the front suspension, the rear suspension and the loincloth-like cover segment to the torso through once operation are passed through the tubular bags;

hard members for use in holding a shape of the cover are arranged at both side positions of the loincloth-like cover segment; and there are provided fastening strings for fixing the loincloth-like cover segment to the side surface of the torso.

* * * * *